US006712743B2

(12) United States Patent
Chen

(10) Patent No.: US 6,712,743 B2
(45) Date of Patent: Mar. 30, 2004

(54) MULTI-FUNCTIONAL EXERCISER

(76) Inventor: Ping Chen, No. 29, Nanmei St., Nantun Li, Nantun Dist., Taichung (TW)

( * ) Notice: Subject to any disclaimer, the term of this patent is extended or adjusted under 35 U.S.C. 154(b) by 197 days.

(21) Appl. No.: 10/011,738

(22) Filed: Dec. 11, 2001

(65) Prior Publication Data

US 2003/0109363 A1 Jun. 12, 2003

(51) Int. Cl.[7] ..... A63B 26/00

(52) U.S. Cl. ..... 482/142; 482/907; 482/147; 482/146; 482/77

(58) Field of Search ..... 482/142, 136, 482/147, 137, 148, 146, 143, 144, 907, 77, 34

(56) References Cited

U.S. PATENT DOCUMENTS 5,997,450 A * 12/1999 Wilkinson ..... 482/142

* cited by examiner

*Primary Examiner*—Nicholas D. Lucchesi
*Assistant Examiner*—L Amerson
(74) *Attorney, Agent, or Firm*—Rosenberg, Klein & Lee

(57) ABSTRACT

An exerciser has a base, a rocking frame and a back pad. The rocking frame is pivotally attached to the top of the base and adapted for a user rocking the rocking frame relative to the base. The back pad is mounted on the rocking frame and adapted for the user to lay on the back pad. With such an exerciser, the user not only can train the abdominal muscles of user, but also can swing, twist or expand his or her body.

12 Claims, 6 Drawing Sheets

MULTI-FUNCTIONAL EXERCISER

BACKGROUND OF THE INVENTION

1. Field of the Invention

The present invention relates to an exerciser, and more particularly to a multi-functional exerciser that can be used in different ways.

2. Description of Related Art

Indoor exercisers have become popular in recent years due to their convenience in providing exercise no matter how bad the weather might be outside, avoiding the troubles and costs involved in going out to a gym, and eliminating the personal security dangers exercisers may be exposed to while exercising in a park. However, the conventional indoor exerciser only has one function for example an abdominal exerciser as shown in FIG. 6. The conventional abdominal exerciser comprises a base (60) and back pad (64). The base (60) is composed of a front leg (61), a main beam (63) and at least one supporting rod (62). The main beam (63) is secured at one end thereof to the front leg (61). The other end of the main beam (63) rests on the ground. The supporting rod (62) is laterally mounted on the front leg (61) for the user's feet to abut on the supporting rod (62). The back pad (64) is secured to the top of the main beam (63) for the user to lay on the back pad (64). Accordingly, the user can train the abdominal muscles with the abdominal exerciser by means of sitting up on the back pad (64) while being secured by feet hooked around the supporting rod (62). However, the conventional abdominal exerciser only has one function as mentioned before. The user cannot use the conventional abdominal exerciser to swing, to twist or to expand the body and thus the use of the conventional abdominal exerciser is not versatile.

To overcome the shortcomings, the present invention tends to provide an exerciser to mitigate or obviate the aforementioned problems.

SUMMARY OF THE INVENTION

The main objective of the invention is to provide an exerciser that not only can be used to train the abdominal muscles of user, but also can be used to swing, to twist or to expand the body of the user. The exerciser has a base, a rocking frame and a back pad. The rocking frame is pivotally attached to the top of the base and adapted for a user to rock on the rocking frame relative to the base. The back pad is mounted on the rocking frame and adapted for the user to lay down on the back pad. This exerciser is especially versatile due to the novel rocking exercises and provides a distinct advantage over the prior art. Other objects, advantages and novel features of the invention will become more apparent from the following detailed description when taken in conjunction with the accompanying drawings.

DETAILED DESCRIPTION OF PREFERRED EMBODIMENT

Figure 1:
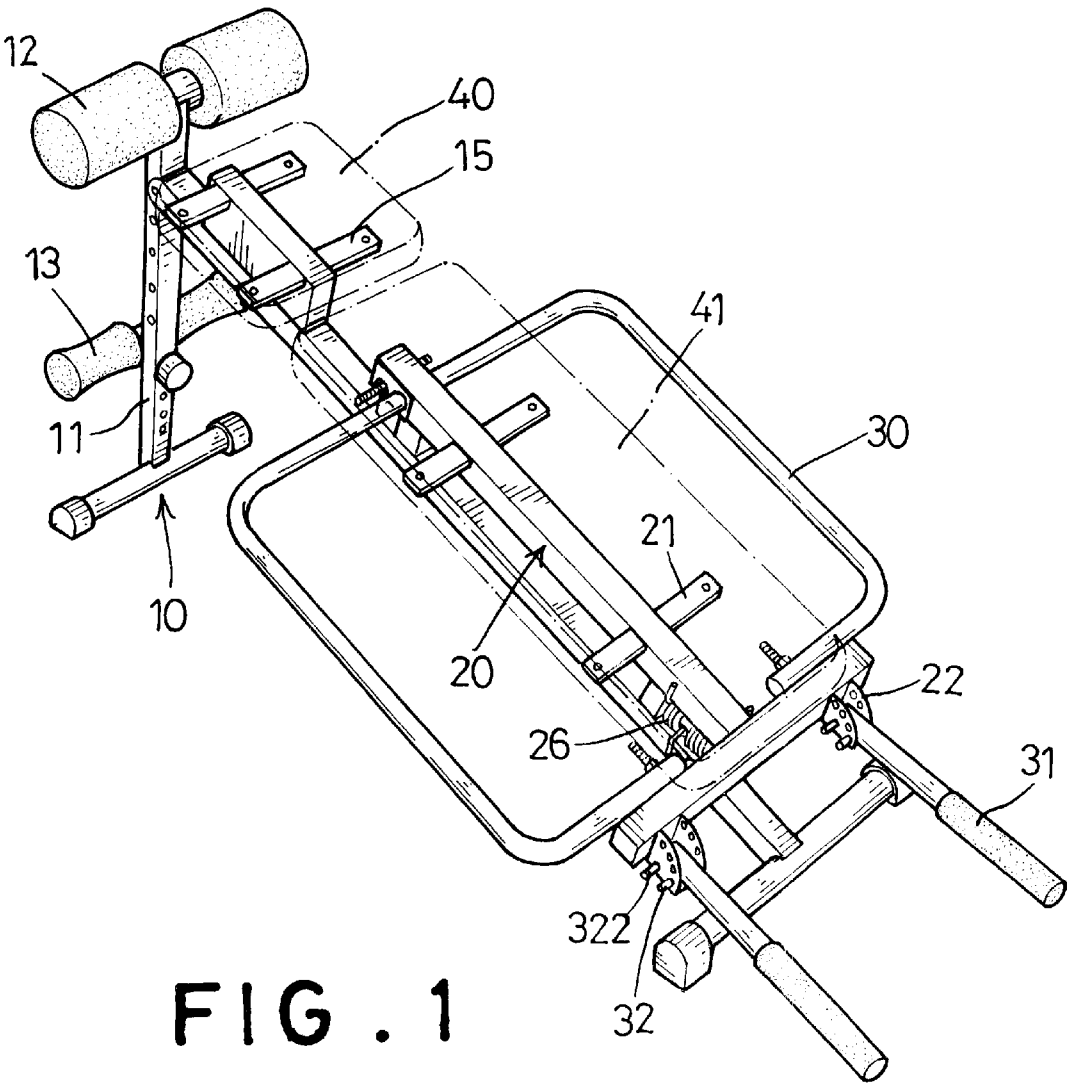
FIG. 1 is a perspective view of an exerciser in accordance with the present invention.
Figure 2:
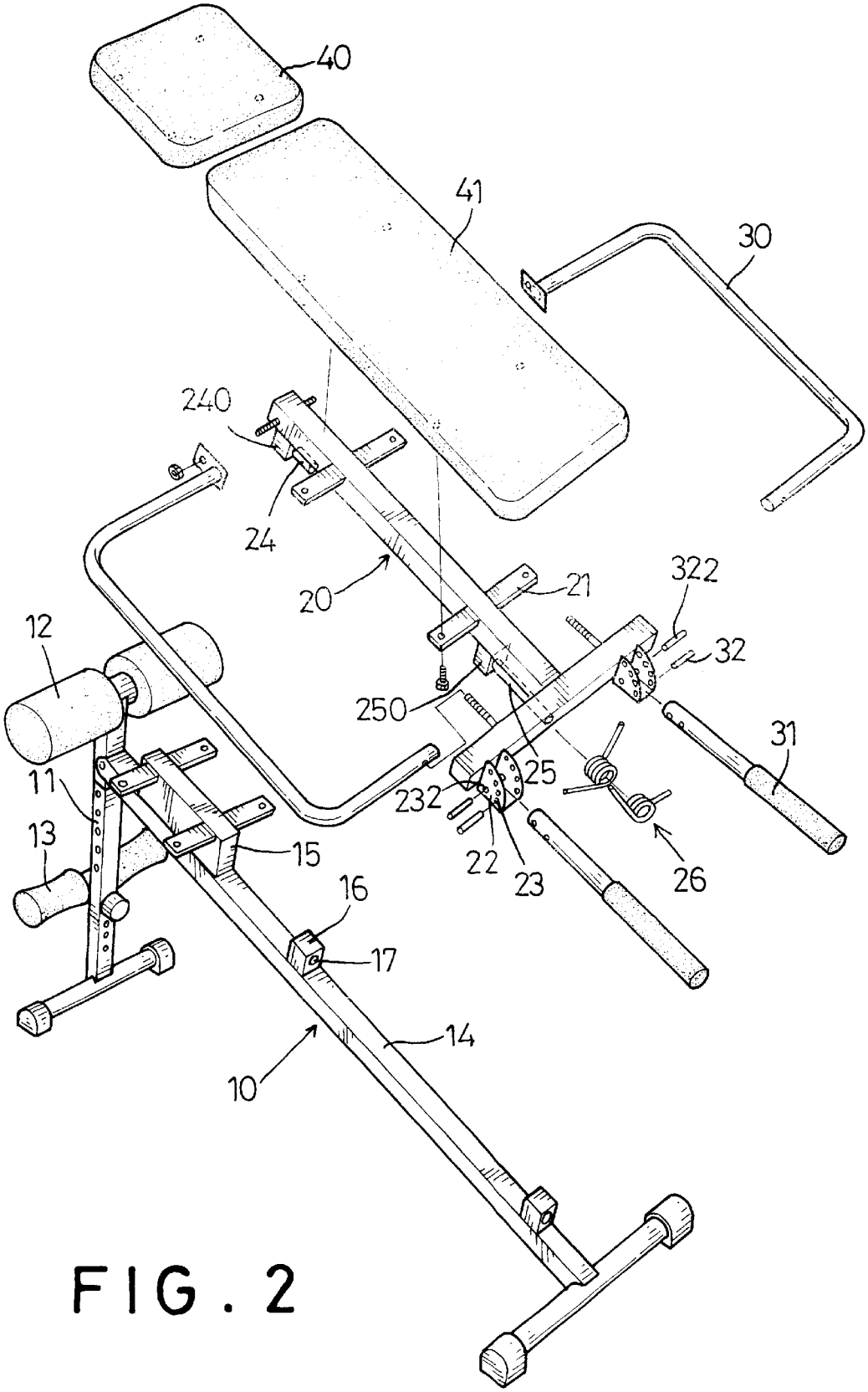
FIG. 2 is an exploded perspective view of the exerciser in FIG. 1.

With reference to FIGS. 1 and 2, an exerciser in accordance with the present invention comprises a base (10), a rocking frame (20) and a back pad (41). The base (10) comprises a front leg (11) and a main beam (14). The main beam (14) has one end securely attached to the front leg (11), and the other end of the main beam (14) rests on the ground. Consequently, the main beam (14) is securely attached at an inclination to the front leg (11). Two supporting rods (12,13) laterally extend from two sides of the front leg (11) and are parallel to each other. In practice, the front leg (11) is telescopic to allow the user to adjust the height of the front leg (11) and thus the main beam (14) is inclined relative to the ground.

The rocking frame (20) is pivotally attached to the top of main beam (14) of the base (10). The rocking frame (20) comprises a longitudinal bar (not numbered) and a lateral bar (not numbered) securely attached to one end of the longitudinal bar far away the front leg (11) of the base (10). To pivotally attach the rocking frame (20) to the base (10), two fixed blocks (16) are separately mounted on the top of the main beam (14). A pivot hole (17) is defined in each respective fixed block (16) and aligns with the pivot hole (17) in the other fixed block (16). Two rocking blocks (240,250) are separately mounted on the bottom of the rocking frame (20) and each corresponds to one of the fixed blocks (16) on the main beam (14). A pivot pin (24,25) laterally extends from each respective rocking block (240, 250) and into the pivot hole (17) in the corresponding one of the fixed blocks (16). Accordingly, the rocking frame (20) is pivotally attached to the main beam (14). In addition, with reference to FIG. 3, a gap is defined between the top of the main beam (14) and the bottom of each rocking block (240,250) on the rocking frame (20) so as to allow the rocking frame (20) to pivotally rotate relative to the main beam (14). In another embodiment, the pivot holes (17) are defined in the rocking blocks (240,250) on the rocking frame (20) and the pivot pins (24,25) are arranged on the fixed blocks (16) on the base (10).

Figure 3:
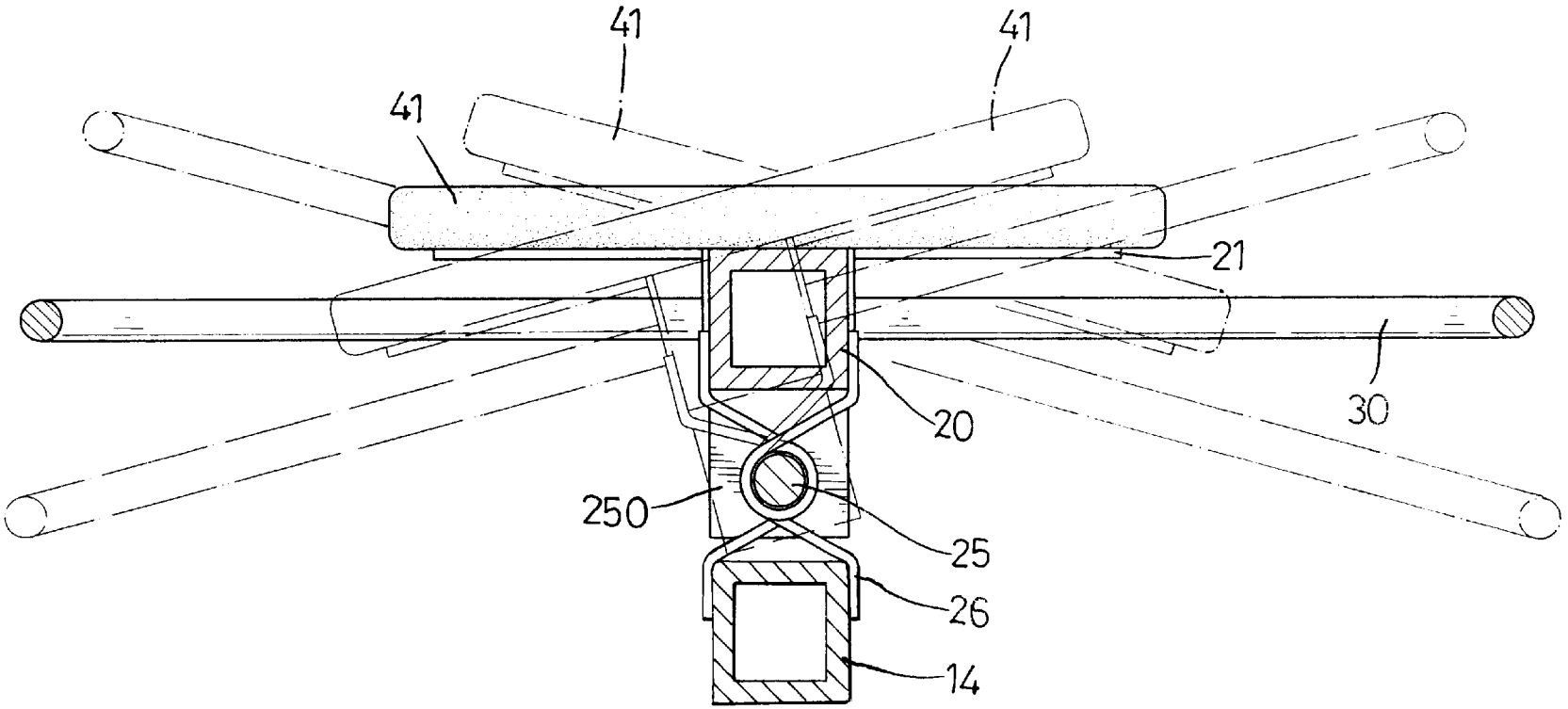
FIG. 3 is an operational plan view in partial section of the exerciser in FIG. 1 showing that the rocking frame rocks relative to the base.

With reference to FIGS. 1 to 3, two torsion springs (26) are attached to one of the pivot pins (25) on the rocking frame (20). Each spring (26) has a first end abutting one side of the rocking frame (20) and a second end abutting one side of the main beam (14). The first ends of the torsion springs (26) are respectively located on two sides of the pivot pin (25) to which the two springs (26) are attached.

Two side handles (30) are respectively mounted on two sides of the longitudinal bar of the rocking frame (20) and adapted for the user to grip on the side handles (30). Two rear handles (31) are adjustably attached to the lateral bar of the rocking frame (20) and adapted for the user to grip on the rear handles (31). In practice, a handle frame (22) is secured to the rear bar for each respective rear handle (31) attached to the handle frame (22). Multiple first bores (23) are defined in each respective handle frame (22) in a curve. A second bore (232) is defined in each respective handle frame (22) at a central point of the first bores (23). A first pin (32) extends through one of the first bores (23) in each respective handle frame (22) and into the corresponding rear handle (31). A second pin (322) extends through the second bore (232) in each respective handle frame (22) and into the corresponding rear handle (31). Consequently, each rear handle (31) can be positioned relative to the corresponding handle frame (22). When the first pin (32) is released from the first hole (23) in the handle frame (22), the rear handle (31) can rotate relative to the handle frame (22). The rear handle (31) will be positioned in a different position as the first pin (32) is inserted into another first hole (23) aligning with the rear handle (31). The rear handles (31) are adjusted relative to the rocking frame (20).

The back pad (41) is mounted on the rocking frame (20) and adapted for the user to lay down on the back pad (41). At least one plate (21) laterally extends from two sides of the longitudinal bar of the rocking frame (20) to support the back pad (41). In addition, a seat bracket (15) is mounted on the top of the main beam (14). A seat pad (40) is mounted on the seat bracket (15) and aligns with the back pad (41).

Figure 4:
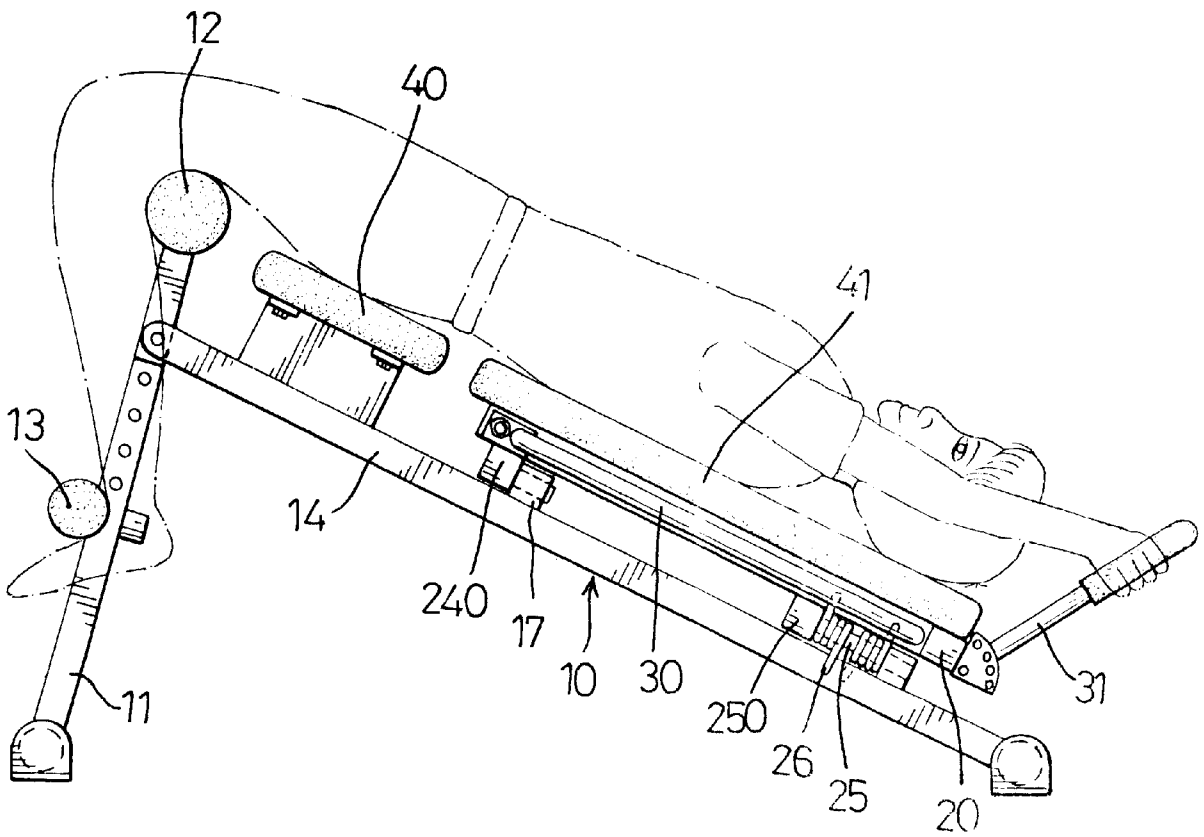
FIG. 4 is a side plan view of a first operational embodiment of the exerciser in FIG. 1.

With reference to FIGS. 3 and 4, the user can lay on the back pad (41) with legs and feet hooking on the supporting rods (12,13) on the base (10). The user grips the rear handles (31) or the side handles (30) with hands, and the buttocks of the user are supported on the seat pad (40). Under such a condition, the user not only can train the abdominal muscles by means of lifting up his or her body, the user can also twist or swing his or her body because the rocking frame (20) is pivotally attached to the base (10). The rocking frame (20) will rock relative to the base (10) when the user twists or swings his or her body. The rocking frame (20) will push the first end of one of the torsion springs (26), and the torsion spring (26) is compressed. The torsion spring (26) not only can provide a resisting force to the user, but also provides a recoil force to the rocking frame (20). Consequently, the user can twist or swing his or her body repeatedly and gain a training effect. In addition, the muscles of the leg and the body of the user can also be exercised.

Figure 5:
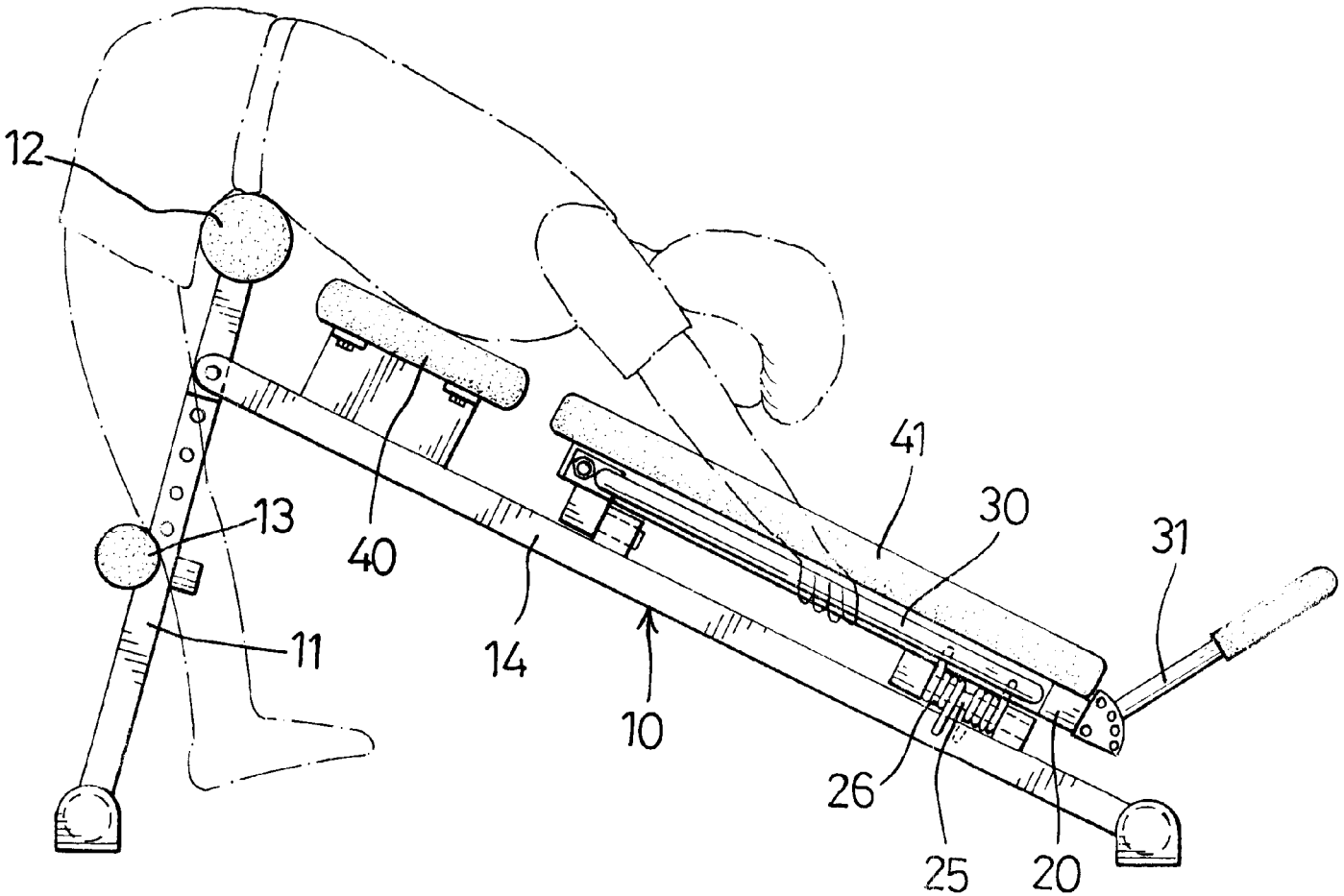
FIG. 5 is a side plan view of a second operational embodiment of the exerciser in FIG. 1.
Figure 6:
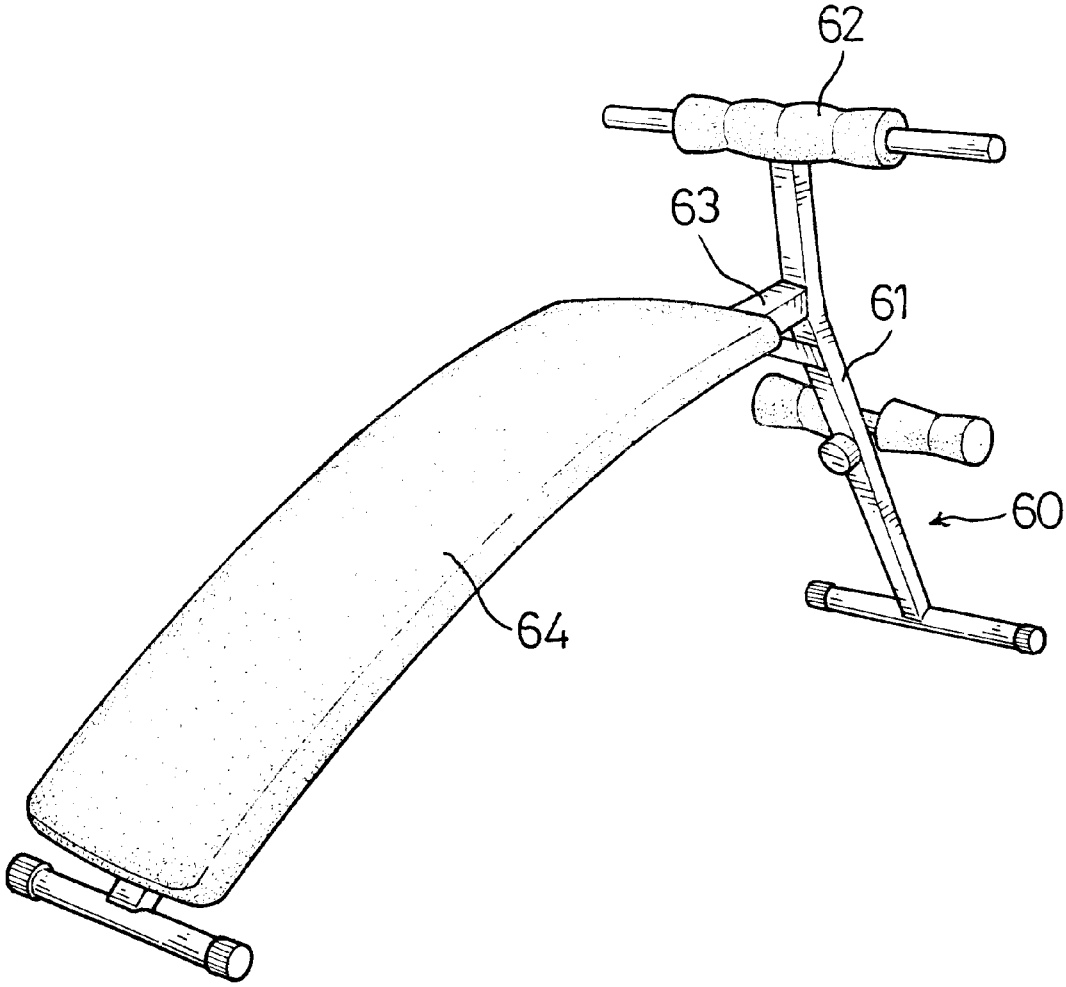
FIG. 6 PRIOR ART
FIG. 6 is a perspective view of a conventional abdominal exerciser in accordance with the prior art.

With reference to FIGS. 3 and 5, the user can lay down on the seat pad (40) or back pad (41) with his or her chest or abdomen, and his or her hands grip on the side handles (30) or the rear handle (31) on the rocking frame (20). The user also can twist or swing his or her body in different ways, and the torsion springs (26) can provide both a resisting force and a recoil force to the user.

In another embodiment, if there is no torsion spring (26) arranged on the exerciser, the user must use force to keep his or her body balance in a pivotable rocking frame. This also can provide an exercising or a training effect to the user.

With such an exerciser, the user can lift up, twist, swing or expand his or her body to train the muscles due to the significant versatility of the exerciser.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exerciser comprising:

a base including:

a telescopic front leg;

a main beam securely coupled in inclined manner to the front leg; and, two supporting rods laterally extending from the front leg and parallel to each other;

a rocking frame pivotally attached to the main beam of the base and adapted for rocking relative to the base; and, a back pad mounted on the rocking frame and adapted for the user to lay on;

at least two fixed blocks separately mounted on the top of the main beam, a pivot hole defined in the respective fixed blocks to align one with the;

at least two rocking blocks separately mounted on a bottom of the rocking frame and each corresponding to one of the fixed blocks on the main beam;

a pivot pin laterally extending from each respective rocking block and into the pivot hole in the corresponding one of the fixed blocks so as to pivotally attach the rocking frame to the main beam, wherein a gap is defined between the top of the main beam and a bottom of each rocking block on the rocking frame to allow the rocking frame to pivotally rotate relative to the main beam.

2. The exerciser as claimed in claim 1 further comprising two torsion springs attached to one of the pivot pins on the rocking frame and each having a first end abutting one side of the rocking frame and a second end abutting one side of the main beam, wherein the first ends of the two torsion springs are respectively located on two sides of the pivot pin to which the two springs are attached.

3. An exerciser comprising:

a base including:

a telescopic front leg;

a main beam securely coupled in inclined manner to the front leg; and, two supporting rods laterally extending from the front leg and parallel to each other;

a rocking frame pivotally attached to the main beam of the base and adapted for rocking relative to the base; and, a back pad mounted on the rocking frame and adapted for the user to lay on;

wherein the rocking frame comprises a longitudinal bar and a lateral bar securely attached to one end of the longitudinal bar offset from the front leg of the base.

4. The exerciser as claimed in claim 3, wherein two side handles are respectively mounted on two sides of the longitudinal bar of the rocking frame for gripping by the user.

5. The exerciser as claimed in claim 3, wherein two rear handles are adjustably attached to the lateral bar of the rocking frame for gripping by the user.

6. The exerciser as claimed in claim 5 further comprising a handle frame secured to the rear bar for each respective rear handle attached to the handle frame;

multiple first bores defined in each respective handle frame in a curve;

a second bore defined in each respective handle frame at a central point of the first bores;

a first pin extending through one of the first bores in each respective handle frame and into the corresponding rear handle; and a second pin extending through the second bore in each respective handle frame and into the corresponding one of the at least one rear handle to position the at least one rear handle relative to the corresponding handle frame.

7. The exerciser as claimed in claim 3 further comprising at least one plate laterally extending from two sides of the longitudinal bar of the rocking frame to support the back pad.

8. The exerciser as claimed in claim 1, wherein two side handles are respectively mounted on two sides of the rocking frame for gripping by the user.

9. The exerciser as claimed in claim 1, wherein at least one rear handle is adjustably attached to the rocking frame for gripping by the user.

10. The exerciser as claimed in claim 9 further comprising a handle frame secured to the rocking frame for each respective at least one rear handle attached to the handle frame;

multiple first bores defined in each respective handle frame in a curve;

a second bore defined in each respective handle frame at a central point of the first bores;

a first pin extending through one of the first bores in each respective handle frame and into the corresponding rear handle; and a second pin extending through the second bore in each respective handle frame and into the corresponding rear handle to position the at least one rear handle relative to the corresponding handle frame.

11. An exerciser comprising:

a base including:

a telescopic front leg;

a main beam securely coupled in inclined manner to the front leg; and, two supporting rods laterally extending from the front leg and parallel to each other;

a rocking frame pivotally attached to the main beam of the base and adapted for rocking relative to the base; and, a back pad mounted on the rocking frame and adapted for the user to lay on;

a seat bracket mounted on the top of the main beam; and, a seat pad mounted on the seat bracket and aligning with the back pad.

12. An exerciser comprising:

a base;

a rocking frame pivotally attached to a top of the base and adapted for a user rocking the rocking frame relative to the base;

a back pad mounted on the rocking frame and adapted for the user to lay on;

a seat bracket mounted on the base; and, a seat pad mo.

* * * * *